US007343284B1

(12) United States Patent
Gazor et al.

(10) Patent No.: US 7,343,284 B1
(45) Date of Patent: Mar. 11, 2008

(54) METHOD AND SYSTEM FOR SPEECH PROCESSING FOR ENHANCEMENT AND DETECTION

(75) Inventors: Saeed Gazor, Kingston (CA); Mohamed El-Hennawey, Belleville (CA)

(73) Assignee: Nortel Networks Limited, St. Laurent (CA)

( * ) Notice: Subject to any disclaimer, the term of this patent is extended or adjusted under 35 U.S.C. 154(b) by 885 days.

(21) Appl. No.: 10/620,453

(22) Filed: Jul. 17, 2003

(51) Int. Cl.
*G10L 21/02* (2006.01)

(52) U.S. Cl. ..... 704/226; 704/208; 704/203; 704/204

(58) Field of Classification Search ..... 704/226, 704/203–204, 208
See application file for complete search history.

(56) References Cited

U.S. PATENT DOCUMENTS 5,453,945 A 9/1995 Tucker et al. ..... 364/725
6,253,165 B1 6/2001 Malvar ..... 703/2
6,487,574 B1 11/2002 Malvar ..... 708/400
6,513,004 B1 1/2003 Rigazlo et al. ..... 704/254
6,707,910 B1 * 3/2004 Valve et al. ..... 379/388.06
7,089,178 B2 * 8/2006 Garudadri et al. ..... 704/205
2002/0116187 A1 * 8/2002 Erten ..... 704/233
2003/0061035 A1 * 3/2003 Kadambe ..... 704/203
2004/0002860 A1 * 1/2004 Deisher et al. ..... 704/233

* cited by examiner

*Primary Examiner*—Richemond Dorvil
*Assistant Examiner*—Qi Han
(74) *Attorney, Agent, or Firm*—Kent Daniels; Ogilvy Renault, LLP

(57) ABSTRACT

A method for discriminating noise from signal in a noise-contaminated signal involves decomposing a frame of samples of the signal into decorrelated components, and using a difference between probability distributions of the noise contributions and the signal contributions to identify signal and noise. A Gaussian distribution is used to determine whether the components are only noise whereas a Laplacian distribution is used to determine whether the components contain the signal. Such discrimination may be used in speech enhancement or voice activity detection apparatus.

6 Claims, 4 Drawing Sheets

METHOD AND SYSTEM FOR SPEECH PROCESSING FOR ENHANCEMENT AND DETECTION

CROSS-REFERENCE TO RELATED APPLICATIONS

This is the first application filed for the present invention.

MICROFICHE APPENDIX

Not Applicable.

TECHNICAL FIELD

The invention relates to digital voice processing, and in particular to a voice processing technique for use in speech enhancement and voice activity detection.

BACKGROUND OF THE INVENTION

Digital voice processing is used in a number of applications for different purposes. Some of the more commercial applications involve data compression and encoding, speech recognition, and speech detection. These applications are in demand in enterprises such as telecommunications, recording arts and the entertainment industry, security and identification enterprises, etc.

Generally all of these applications involve receiving an audio signal, sampling the audio signal to derive a digital representation, extracting overlapping frames of consecutive samples, and then decomposing the frames in a digital time domain representation into (relatively) uncorrelated components. It has been recognized that sampling a voice signal within an order of magnitude of 10 KHz (10,000 samples per second), and providing a frame size that corresponds to a time window within an order of magnitude of 10 milliseconds may be satisfactory, depending on the specific application. There are many known transforms for decomposing a frame of samples into a plurality of independent components. The most common of these include the frequency-domain transforms such as the Fourier transform, and the discrete cosine transform (DCT), wavelet decomposition transforms such as the standard wavelet transform (SWT), and adaptive transforms like the Karhunen-Löeve Transform.

The Fourier Transform decomposes the samples in the window into frequency components. While the Fast Fourier transform can be performed quickly, the resulting frequency spectrum has disadvantages in that it has a predefined fixed resolution. Decomposition into the time-frequency domain, (e.g. by the DCT) provides frequency spectrum information relative to a given time. The DCT in particular is a low complexity decomposition technique that can provide an excellent basis for producing highly uncorrelated components.

Wavelet decomposition transforms the time domain signal into corresponding wavelets. Wavelets are mathematical functions that are useful for representing discontinuities. Adaptive basis transformations, such as the KLT continuously tweak the basis functions into which the signal is decomposed, in an effort to maximize the capacity of the basis functions to represent the signal. While these decomposition techniques (and more besides) all provide sufficiently independent components, each has its own computational complexity, and each set of components provides its own accuracy of representation with respect to a given signal domain. Accordingly each of these decompositions may be useful in different types of applications, for use in different environments.

Removing noise from a noise-contaminated voice signal is a well known problem in this field. In substantially all applications it is useful to remove noise. Typically noise is not appreciated by telephone users, media users, etc., and is known to interfere with voice identification. Moreover the transmission of noise-contaminated data, or the encoding of noise on storage media is inefficient. The filtering of digital data to remove the noise is therefore widely recognized to be of value.

One feature of audio data that makes the filtering difficult is that the voice signal is punctuated with silence. Speakers typically pause between words or sentences and at other times when required to produce the sounds they make, e.g. before a plosive, after a stop, etc. The reason that this makes noise filtering difficult is that unless the silent and voice-active intervals are detected, the same filtering function cannot be applied unless a relatively poor quality of filtering is acceptable. Typically a voice activity detector (VAD) is used to classify a frame as either voice-active or silent.

Of course, discriminating between noise and voice at a VAD is not significantly easier than the separation of noise from the voice signal. These problems are strongly analogous. Known techniques for accomplishing this are very complex or have a low reliability, or both. The prior art methods have typically used a model based on a Gaussian noise distribution, and a Gaussian voice distribution, and use statistical analysis of energy distribution to separate the noise from the voice.

What is needed is an efficient and reliable way of separating noise from a noise-contaminated signal, especially noise from a noise-contaminated voice signal.

SUMMARY OF THE INVENTION

It is therefore an object of the invention to provide a method and apparatus for separating noise from a noise-contaminated signal that is efficient and reliable.

It is a further object of the invention to provide a method and apparatus for separating noise from a noise-contaminated voice signal that can be used to filter the noise components, or to detect voice activity.

The invention therefore provides a method for discriminating noise from signal in a noise-contaminated signal. The method comprises steps of decomposing a frame of the noise-contaminated signal received in a predefined time period into decorrelated signal components; recursively updating respective parameters characterizing a Gaussian noise distribution and a signal distribution of each of the respective components as a function of time; and, using the respective parameters to evaluate a composite Gaussian noise and signal distribution function to provide a measure of noise and signal contributions to the component.

If the signal is a noise-contaminated voice signal respective parameters characterizing the Gaussian noise distribution and a Laplacian voice distribution are recursively updated. Recursively updating may comprise using a value computed when the components of a previous frame were processed to determine which of the parameters characterize the respective distribution to update. The previously computed value may be an a priori probability of the frame constituting noise, and using the a priori probability to determine which of the parameters to update may comprise selecting a measure of variance that characterizes the Gaussian noise distribution if the a priori probability is below a predetermined threshold; and otherwise selecting a measure of variance factor that characterizes the Laplacian distribution. The a priori probability may be defined by evaluating a hidden state of a hidden Markov model.

Recursively updating the parameter may further comprise incrementally changing the parameter in accordance with a difference between an expected value of the component given the past value of the parameter, and the value of the component received. Incrementally changing may comprise applying a first order smoothing filter to the components, and a time constant of the first order smoothing filter may be chosen as a time during which the distribution is stationary.

Using the respective parameters to determine which of the parameters to update may comprise computing a measure of fit of the components to a composite Gaussian and Laplacian distribution, and computing a measure of fit of each of the received components to a respective Gaussian noise distribution defined using the respective parameters; and comparing a mean of the measures of fit to the respective Gaussian noise distributions with a mean of the measures of fit to the composite Gaussian and Laplacian distributions, to compute a likelihood that the components of the frame constitute noise or noise-contaminated voice signal.

Computing the measure of fit to either of the distributions may comprise evaluating the distribution at the value of the component received, and comparing a mean of the measures of fit may comprise dividing a product of the measures of fit of the components to the composite distribution by a product of the measures of fit of the components to the noise distribution. Using the respective parameters to evaluate may further comprise using the likelihood and the a priori probability to compute an a posteriori probability that the frame is noise-contaminated voice signal.

Using the respective parameters to evaluate may further comprise using the a posteriori probability and a predefined fixed set of transition probabilities to compute an a priori probability that a next frame constitutes noise-contaminated voice signal.

The frame may be decomposed by applying a matrix transform to the frame, which consists of a predefined number of samples. The matrix transform may comprise mapping the frame of samples from a time domain to a time-frequency domain. Mapping the frame may comprise applying a discrete cosine transform to the frame of samples.

The frame may also be decomposed by mapping the frame of samples to basis functions, which are the applied to the components. Mapping the frame may comprise decomposing the frame into at least one of wavelets and sinusoidal functions. The basis functions may be recomputed to adaptively optimize decomposition. Applying the matrix transform may comprise applying an adaptive Karhunen-Loeve transform.

Using the parameters to evaluate may also comprise computing at least an approximation to an expected value of the composite Gaussian and signal distribution using the value of the component, and the parameters, to obtain a signal-enhanced component, if it is determined that the frame is signal active. Computing at least an approximation may comprise computing a piece-wise linear function approximation of the expected value as a function of the parameters and the component.

The invention further provides an apparatus for speech enhancement, comprising a signal transformer for decomposing a frame of samples of a noise-contaminated speech signal received in a predetermined time interval into decorrelated signal components; a component distribution parameter reviser for recursively updating respective parameters characterizing a Gaussian noise distribution and a Laplacian speech distribution of each of the respective components as a function of time; a voice activity detector for determining whether the noise-contaminated speech signal is voice active in the time interval; and a clean speech estimator for using composite Gaussian and Laplacian distributions defined with the parameters, and the values of the components to obtain a vector of speech-enhanced components, if it is determined by the voice activity detector that the frame is voice active. The apparatus may further comprise an inverse signal transform for re-composing the frame of samples.

The clean speech estimator computes an expected value of each of the composite distributions to independently derive a speech-enhanced component corresponding to each of the components. The signal transform may comprise means for decomposing the frame of samples using a discrete cosine transform.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention differentiates noise from signal by the characteristic distributions normally associated with each. It has been found that the components of a signal (in particular speech signals, although the same may apply to other signals) are characterized by a Laplacian distribution, whereas noise is characterized by a Gaussian distribution. This fact is used to differentiate noise from signal in a noise-contaminated voice signal. Preferably, parameters that characterize the Laplacian and Gaussian distributions are maintained, and a composite distribution is used to identify the signal and the noise contributions to an instant value of the respective components. This differentiation can be used for example to detect voice activity on a noise-contaminated channel, and/or to enhance speech.

Speech Enhancement

Figure 1A:
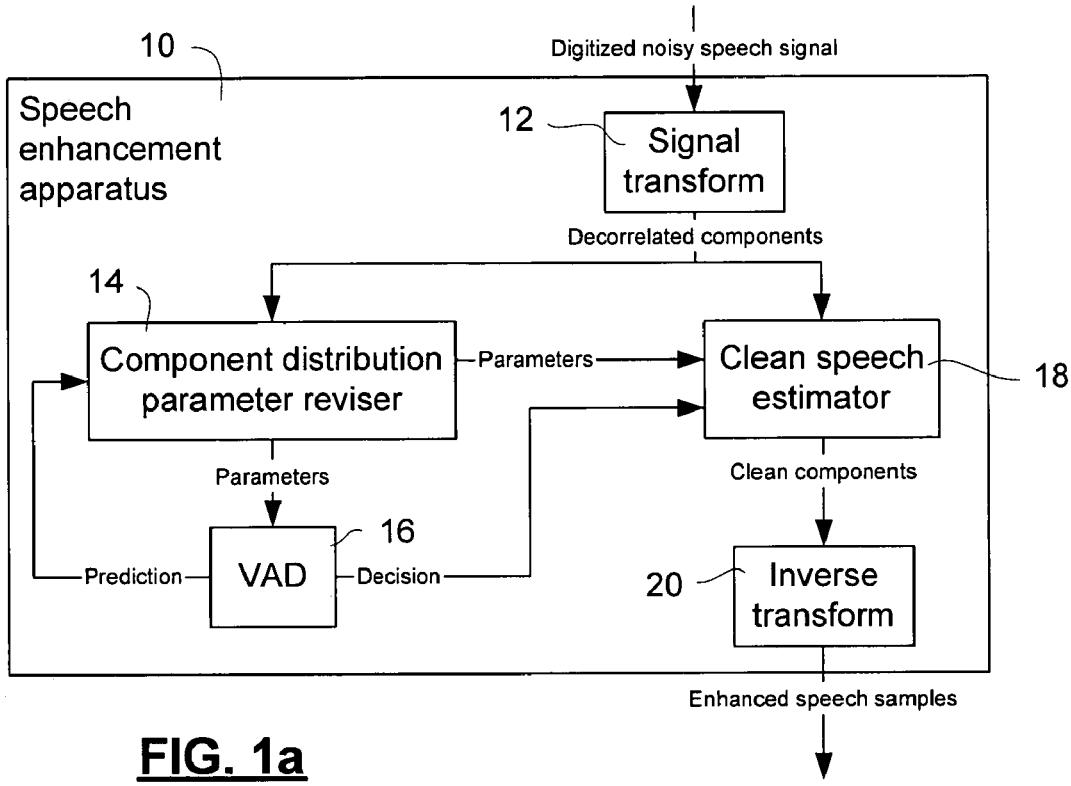
FIG. 1*a* is a schematic block diagram illustrating a speech enhancement apparatus incorporating a voice activity detector in accordance with the invention.

FIG. 1*a* schematically illustrates principal functional blocks of a speech enhancement apparatus 10 in accordance with the invention. The speech enhancement apparatus 10 includes a signal transform 12, a component distribution parameter reviser 14, a voice activity detector 16 (VAD), a clean speech estimator 18, and an inverse transform 20.

The signal transform 12 decomposes a digitized noise-contaminated speech signal into respective decorrelated components that are less correlated to each other than the samples (i.e. the digital values) of a frame of samples from which the components were derived. The decorrelated components are preferably substantially uncorrelated. The digitized samples are received, and an overlapping frame of samples is assembled as follows: each of the samples is received at a predetermined sample rate, and consecutive frames of K of those samples are assembled, when n of the K samples appear in each of two adjacent frames. The n overlapping samples ensure that voice features that occur near the frame boundaries are not lost. This sample framing technique is well known in the art. Each frame is then decomposed, preferably using a matrix transformation or a similar computationally-bounded process. Any one of many decompositions known in the art may be used, such as the Fourier transform, the discrete cosine transform (DCT), or other time-frequency domain transforms, a wavelet decomposition transform, or a transform to any other basis of substantially uncorrelated components, even if the basis components are adaptively varying like in the adaptive Karhunen-Loeve transform.

The decorrelated components are passed to the component distribution parameter reviser 14, and the clean speech estimator 18. The component distribution parameter reviser 14 uses each received component and a prediction received from the VAD 16 after the VAD 16 has processed a previous component, to update corresponding parameters of the Gaussian noise and Laplacian signal distributions. The prediction is used to determine which of the parameters to update. If the frame just decomposed is predicted to contain only noise, parameters of the Gaussian distribution are updated. As the noise distributions and Laplacian signal distributions are both assumed to be zero mean distributions, a single parameter related to a variance of the distribution is sufficient to characterize either of the distributions. More specifically the variance of the noise distribution, and the Laplacian factor of the signal distributions can be used, for example.

The selected parameter is then updated using a difference between the expected value of the component given the previous value of the parameter, and the actual value of the component. A low-complexity equation for computing a new value for the parameter can be chosen as a weighted average of the previous value of the parameter and the difference, where the weighting ensures that the value of the parameter varies slowly as a function of time.

The VAD 16 receives the current parameters and computes a probability that decorrelated components of a respective frame constitute noise or noise-contaminated speech. The VAD 16 may compute the probabilities using a Hidden Markov Model (HMM), for example, in a manner explained below with reference to FIG. 4. The VAD outputs a decision regarding the components of a frame to the clean speech estimator 18, and outputs a prediction that the next frame is noise or noise-contaminated speech to the component distribution parameter reviser 14. The prediction enables the component distribution parameter reviser 14 to select the parameters to be updated for the respective components.

The clean speech estimator 18 receives each decorrelated component and computes an expected value of a clean speech component of the signal. Computing the expected value may involve computing an approximation to a theoretically derived composite probability distribution, as described below with reference to FIG. 2. If the noise is assumed to be additive, the clean speech estimator 18 will attenuate the signal in proportion to the amount of noise estimated to be contributing to the component. The clean speech components are then transformed to the time domain by the inverse transform 20, which is the inverse of the signal transform 12.

The inverse transform 20 is unnecessary if the speech enhancement apparatus 10 is designed to permit voice authentication over a noise-contaminated channel, or the clean speech signal is to be stored in a compressed format.

There are many configurations of the speech enhancement apparatus 10 that may be suited for different underlying technologies. In general, the speech enhancement may be performed by encoding the functions shown in FIG. 1*a* in an integrated circuit, or other special purpose hardware, in which case these functions may be performed in parallel. However, the speech enhancement may also be performed serially, or performed in a multi-thread computing environment. The functional blocks can be arrayed in serial order as follows: the signal transform 12 receives the signal, transforms it, and sends the components to the component distribution parameter reviser 14 where they are used to revise the parameters using a value previously supplied by the VAD 16. The component distribution parameter reviser 14 sends the updated parameters and components to the VAD 16. The VAD 16 then computes the decision, forwards the decision, the parameters, and the components to the clean speech estimator 18, and returns the prediction to the component distribution parameter reviser 14. The clean speech estimator 18 then computes the expected clean speech components and forwards them to the inverse transform 20.

However, as illustrated, some of these steps can be performed concurrently to reduce a processing time for a given frame by leveraging the fact that the parameters vary slowly as a function of m, especially when the sample overlap n is high. Specifically the clean speech estimator 18 may begin processing the decorrelated components of frame m at the same time that the VAD 16 computes its decision based on the parameters computed from the components of the frame m. In order to do so, the clean speech estimator 18 applies to the components of frame m a decision made by the VAD 16 in a previous time unit. Given that the decision varies slowly, no appreciable penalty in performance is incurred by this parallel processing. Parallel processing can also be performed at the VAD 16 by using parameters received from the component distribution parameter reviser 14 in a previous time unit, to arrive at a decision one time unit later. The clean speech estimator 18 may also use a decision made two time units (or more) prior to the components, and one time unit prior to the parameters.

The component distribution parameter reviser 14 keeps the component distributions current. The parameter values are required by both the clean speech estimator 18 and the VAD 16. For this reason, and in order to maintain a uniform model of the data, it is convenient to use the VAD of the present invention in concert with the clean speech estimator 18. However, in some applications, the VAD in accordance with the invention may not be used. If another VAD is used, that VAD may not output both predicted and decided values, and consequently a speech enhancement apparatus of a type illustrated in FIG. 1*b* may be used.

Figure 1B:
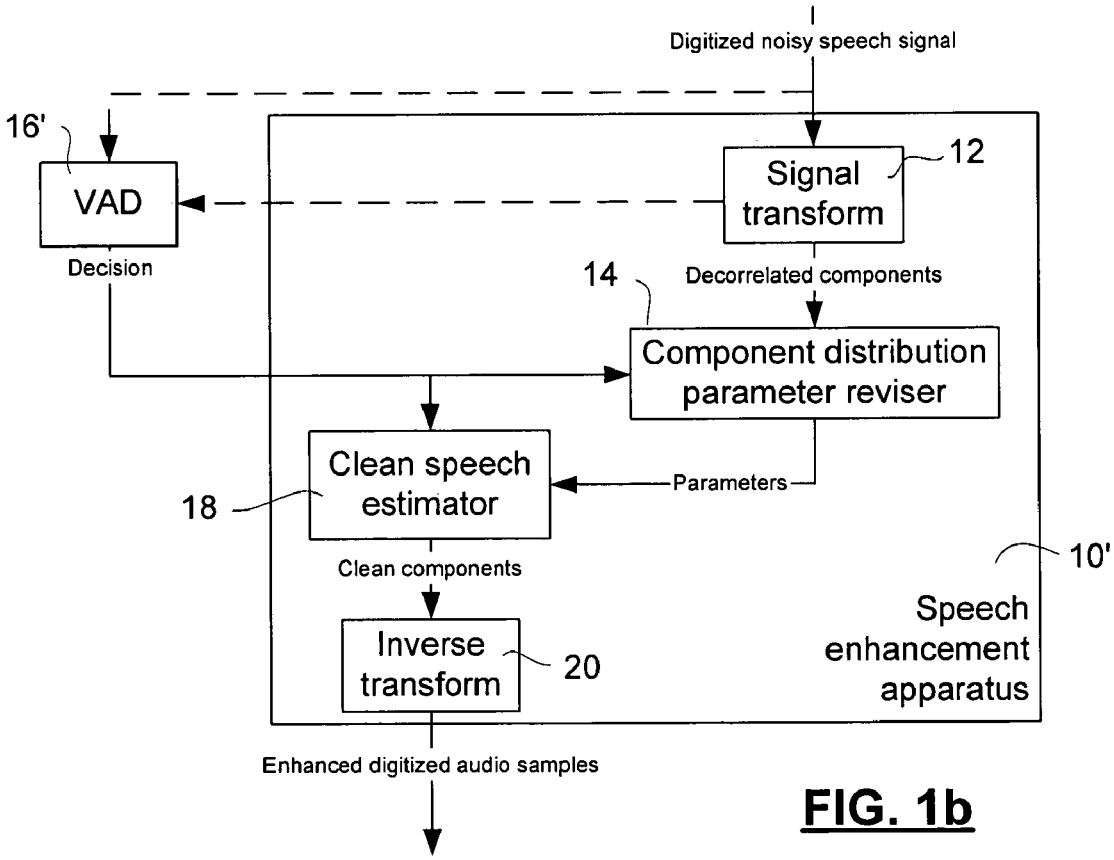
FIG. 1*b* is a schematic block diagram illustrating a speech enhancement apparatus in accordance with the invention for use with any voice activity detector.

The functional blocks of a speech enhancement apparatus 10' shown in FIG. 1*b* that are substantially identical to those shown in FIG. 1*a* are identified using the same reference numerals and their descriptions are not repeated. The speech enhancement apparatus 10' is designed to work with any commercially available VAD 16'. While many newer VADs are adapted to provide soft output (information relating to how a hard output was derived, a confidence measure, uncertainty, etc.), all VADs output a value that can be interpreted as a decision respecting each of the components of a frame (or a point or interval of time) collectively. The decision output by the VAD 16' is used by both the component distribution parameter reviser 14, (which treats the decision as equivalent to the prediction issued by VAD 16 shown in FIG. 1*a*) and the clean speech estimator 18'. The VAD 16' may receive the digitized samples in parallel with the signal transform 12, may receive the frames, or may receive the decorrelated components from the signal transform 12, but it is provided with data for making decisions regarding the voice activity/silence of corresponding frames.

Figure 2:
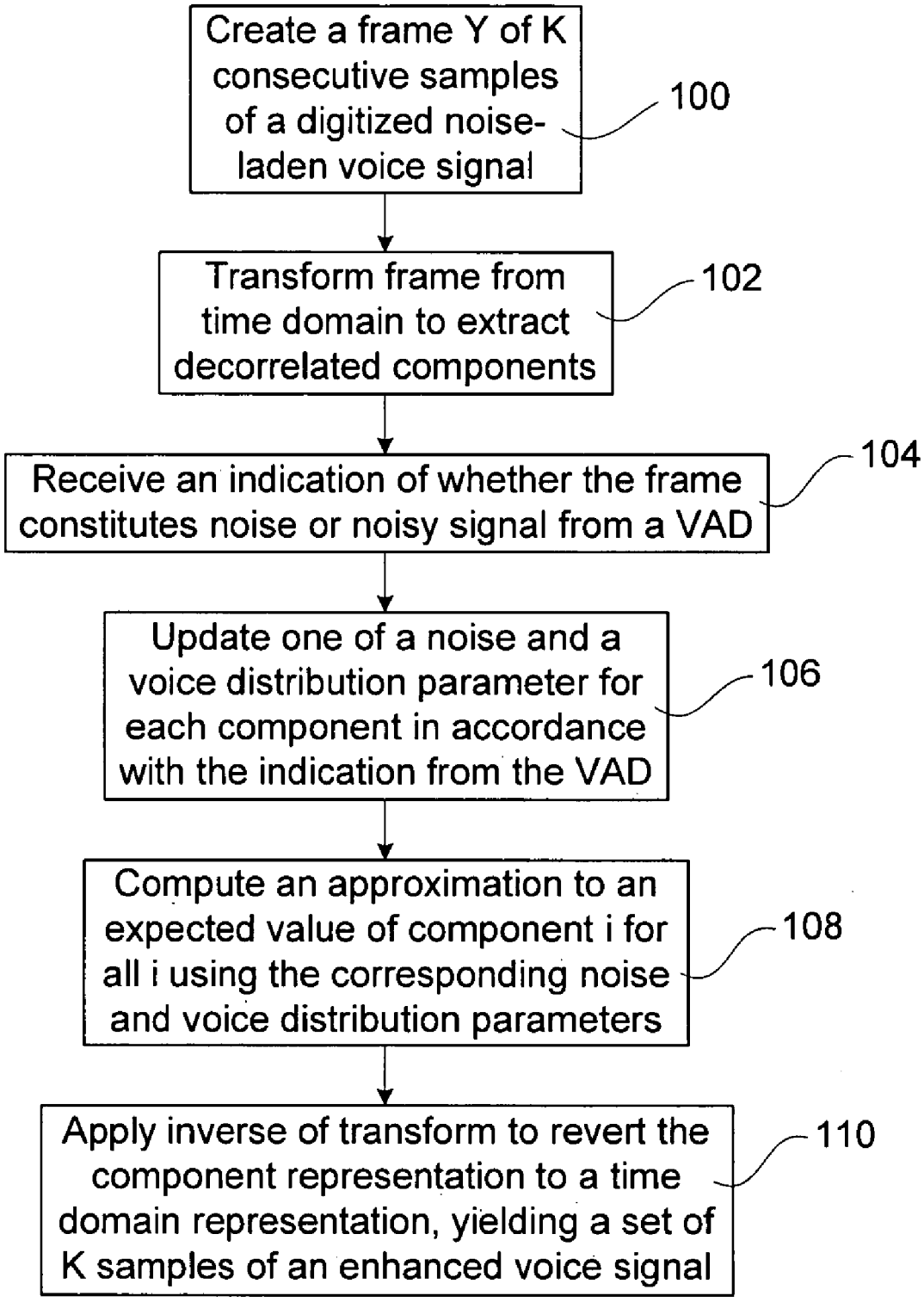
FIG. 2 is a flow chart illustrating principal steps involved in speech enhancement in accordance with an embodiment of the invention.

Principal steps involved in speech enhancement in accordance with an embodiment of the invention are shown in FIG. 2. The process begins in step 100 by creating a frame Y of K samples of a received digitized noise-contaminated voice signal, at a predefined frame rate. The K samples of each frame Y overlap the K samples of the previous frame (y−1) in a predefined manner so that each frame includes n samples that were present, in a previous frame, and n samples that will be included in a next frame. The frame period (the reciprocal of the frame rate) is therefore less than a time window from which its samples were extracted. If only one new sample is included in each frame, the frame rate is the sample rate, and each sample will appear in K successive frames. While it is necessary to overlap the samples in successive frames to ensure that voice features are not lost at frame transition boundaries, it has been found that for some applications, an overlap of 25% (n=K/4) or less is sufficient. A typical example is a frame for which K=80 and n=70. For example 80 samples, received at a 11.012 KHz rate, of which 70 samples are also found in a previous frame, yields a frame rate of about 9,646 frames per second. In general, the greater the sample overlap n: the more processor intensive the process, but the more smoothly parameters of the distributions change. A well known trade-off is therefore made when implementing the process, in order to achieve a desired system response.

Each frame Y, is numbered (m) to permit reference to previous/successive frames. This reference is useful because recursion is used to derive some of the values, in accordance with the preferred embodiment of the invention. Each frame Y(m) is transformed from a time-domain to another domain using a transformation (step 102). Generally, the other domain is a frequency domain, a time-frequency domain, or another domain such as a wavelet or a variable basis domain. The discrete cosine transform (DCT) is a particularly expedient matrix-based time-frequency domain transformation that can be applied. The most important feature of the selected transformation is that it decomposes the received digitized signal into independent or decorrelated components. Each frame Y(m) is decomposed by a transformation into a vector V (also indexed by m) generally having K components, each called $v_i(m)$, where i=1 . . . K. The number of components is not necessarily equal to the number of samples per frame, although this is characteristic of many decomposition transformations.

In accordance with the present invention, the speech enhancement relies on a voice activity detector (VAD) to determine which frames contain only noise, and which contain the voice signal. While the method of the present invention permits voice activity detection with better performance than available in the prior art, and although there are further benefits to be derived from maintaining a uniform model of the speech or like data throughout the processing, it is not necessary to use the VAD 16 of the present invention with the speech enhancer in accordance with the invention. In accordance with the illustrated embodiment, the VAD 16 may be any software/hardware that provides a Boolean output for each frame number m to indicate whether the corresponding vector V(m) is to be processed as noise n, or as noise and speech n+s. The output of the VAD may not actually be Boolean, but may comprise a "soft" decision represented as a probability, a likelihood, a value in fuzzy logic, etc. that can be used to obtain the decision. In step 104, an indication is received from the VAD in relation to the current frame m.

For each component i, two distributions are effectively maintained: one for the values of the component $v_i$ obtained when the frame in which it was received Y(m) was determined to be voice-active (such v=s+n, where s is the speech signal and n is the noise contribution to the component v); and one for the values of the $i^{th}$ component of V, where V is the transform of a silent frame (such v=n). A simplifying approximation is used to determine parameters that characterize the respective component distributions (step 106). If the digital signal that is being processed is static, maintaining these distributions entails no more than determining the mean and variance (and any other parameter required to characterize the distribution). While the variance of the Gaussian distribution changes slowly, (in part because of the n sample overlap of successive frames) speech signals are not static, and the variance drifts over time. This drift will therefore yield considerable errors in a long run, and consequently a method of updating the parameters that characterize the distributions is required. The chosen methods for updating the variance $\sigma^2$ of a Gaussian noise distribution, and estimating a factor $\alpha$ of a Laplacian speech (or other signal) distribution, are as follows.

The noise is modeled as a random variable. More specifically, $\sigma^2$ (indexed by i and/or m, when useful) is the variance, of the noise distribution, which, for present purposes, is taken to be a zero-mean Gaussian distribution. When the VAD determines a frame (m) contains no speech, the corresponding components $v_i$ are treated as noise. Accordingly at these times, the values $\sigma_i^2$ are updated to keep the variance (and the distribution $\sigma_i^2$ characterizes) current with respect, to the components $v_i$ of the noise. An estimate of the variance of the zero-mean Gaussian distribution depends only on the absolute value of the $v_i(m)$, i.e. $\sigma^2$ is equal to the mean square of the v(m) over some suitable range of m. Using a first order smoothing filter upon receipt of each component that is identified as noise, a current value $\sigma_i^2(m)$ of the variance may be computed as follows:

$$\sigma_i^2(m)=\beta_N(\sigma_i^2(m-1))+(1-\beta_N)v_i^2(m)$$

where $\beta_N$ is a positive real number between 0 and 1 chosen to control a rate of change of the variance as a function of m. Specifically, $\beta_N$ is chosen in most embodiments to ensure that only a small change to the $\sigma_i^2$ occurs at each process. $\beta_N$ is therefore close to 1. $\beta_N$ may be chosen to provide a time constant of the filter to correspond to a, period over which the noise is negligible. In some embodiments this is about one half of a second. It will be noted that the calculation is a convex function of the previous $\sigma_i^2$ with the current absolute value, and consequently $\sigma_i^2(m)$ is always between $\sigma_i^2(m-1)$ and $v_i^2(m)$.

In an analogous manner, the Laplacian factor $\alpha$, which is sufficient for characterizing a Laplacian speech distribution, is updated when the received component is identified as noise-contaminated signal. Each component $v_i$ that contains speech is also likely to be contaminated with noise. The Laplacian distribution is a model of clean speech components. Of course if the clean speech components were known per se, there would be no need to discriminate them from the noise. A method for approximating the Laplacian coefficient of a clean speech contribution to the component is therefore used. One low-complexity strategy is to assume that noise is a second order effect and that the received component is predominantly speech, so that the absolute value of $v_i$ is a good approximation to the desired clean speech component. This assumption has been found adequate for certain applications relating to voice signal analysis, however a higher complexity algorithm can be employed to determine, using the current value of $\sigma_i^2$, an updated value of $\alpha_i$. In accordance with the assumption, a smoothing function can be applied to the prior value of $\alpha_i$ as follows:

$$\alpha_i(m)=\beta_S(\alpha_i(m-1))+(1-\beta_S)|v_i(m)|$$

As before $\beta_S$ may be chosen so that speech over the time constant of the filter substantially cancels out. When processing voice data, a longer time constant is required to achieve substantial constancy. It has been found that a time constant of 10 ms is sufficient in some embodiments. It will be appreciated by those skilled in the art that other parameters that characterize the Laplacian distribution could be used, e.g. its variance.

At the completion of step 106, at least one of the parameters is updated and the current values of $\alpha$ and $\sigma^2$ are available to a speech enhancement algorithm. Each of the i components are independently processed because noise does not necessarily equally contaminate each component. This enables the present embodiment to extract "colored" noise from the noise-contaminated signal. However the invention can be practiced without separate processing of the components in applications where that is appropriate.

If the frame Y(m) is indicated to be pure noise by the VAD, each component is attenuated to substantially 0. (Generally a strong (~30 dB) attenuation is preferred if a person is going to listen to the enhanced signal, but 0 is preferred when digital storage is performed (for authentication purposes, etc).

Otherwise, a conditional probability distribution $f_{s|v}(s|v)$ (where s is the clean speech component and v is the received $i^{th}$ component) specified by a theory and model of the signal based on the assumed Gaussian noise and Laplacian speech distributions is used to identify a clean signal component estimated given the observed v (step 108). The current theory assumes that the noise and speech contributions to each component are statistically independent of each other, independent of the contributions to the other components, that the two contributions are purely additive, and that each component represents an uncorrelated random sample. While these assumptions have provided a model that has been verified and provides a wide measure of improvement over existing higher complexity algorithms, these assumptions are not essential to the invention, and merely provide an illustrative framework in which the invention is described.

The conditional probability distribution $f_{s|v}(s_i|v_i)$ is a normalized product of a Laplacian speech distribution $f_{si}$, and a Gaussian noise distribution $f_{ni}$.

$$f_{s,i}=\frac{1}{2a_i}e^{-\frac{|s_i|}{a_i}}$$

$$f_{n,i}=\frac{1}{\sqrt{2\pi}\,\sigma_i}e^{-\frac{(v_i-s_i)^2}{2\sigma_i^2}}$$

$$f_{s_i|v_i}=\frac{\frac{1}{2\sqrt{2\pi}\,\sigma_i a_i}e^{-\frac{|s_i|}{a_i}-\frac{(v_i-s_i)^2}{2\sigma_i^2}}}{\int_{-\infty}^{\infty}\frac{1}{2\sqrt{2\pi}\,\sigma_i a_i}e^{-\frac{|s_i|}{a_i}-\frac{(v_i-s_i)^2}{2\sigma_i^2}}\,ds_i}$$

A precise way to derive s (the clean speech component), involves computing the expectation of s using $f_{s|v}$. The expected value of $s_i$ is a minimum mean square error estimator of $s_i$, as known in the art. The expectation of s is the integral over the outcome space of $sf_{s|v}(s,v)$. While this integral can be computed with arbitrary precision, and various efficient short cuts may be available for approximating the integral, the complexity of computing this integral may not be preferred in some embodiments. It should be noted that the MMSE value provides a more accurate estimate of s when noise is relatively high than most low-complexity approximations. Each implementation generally requires a trade off between a complexity of the computation and accuracy of the approximation, and will usually do so with regard to the domain of the signals the apparatus is designed to process, and the specific demands on the processing apparatus.

Accordingly one very low complexity approximation to the expectation value is a three part piece-wise function that maps s to 0 (or nearly 0) if $v_i$ is between plus and minus $\sigma_i^2/\alpha_i$, maps s to $v_i-\sigma_i^2/\alpha_i$, if $v_i>\sigma_i^2/\alpha_i$, and maps s to $v_i+\sigma_i^2/\alpha_i$, if $v_i\leftarrow\sigma_i^2/\alpha_i$. This approximation is very accurate if the absolute value of $v_i$ is more than two times $\sigma_i^2/\alpha_i$, or less than a third of $\sigma_i^2/\alpha_i$. Of course, other approximations to the integral can be used to generate the approximate expectation of s, that will be accurate within respective regimes as desired.

Each of the vector components $v_i$ is replaced with a respective clean speech component $s_i$, and in step 110, the inverse transform is applied to the clean speech vector $S_i$ i=1 . . . K to retrieve a time-domain output frame Z(m) of K samples. Any of a plurality of known techniques for overlaying the samples of the successive output frames Z can be used with corresponding advantages and limitations. Such techniques include weighted averaging of the sample values, selection of a mean or otherwise preferred sample, etc.

Voice Activity Detector

Figure 3:
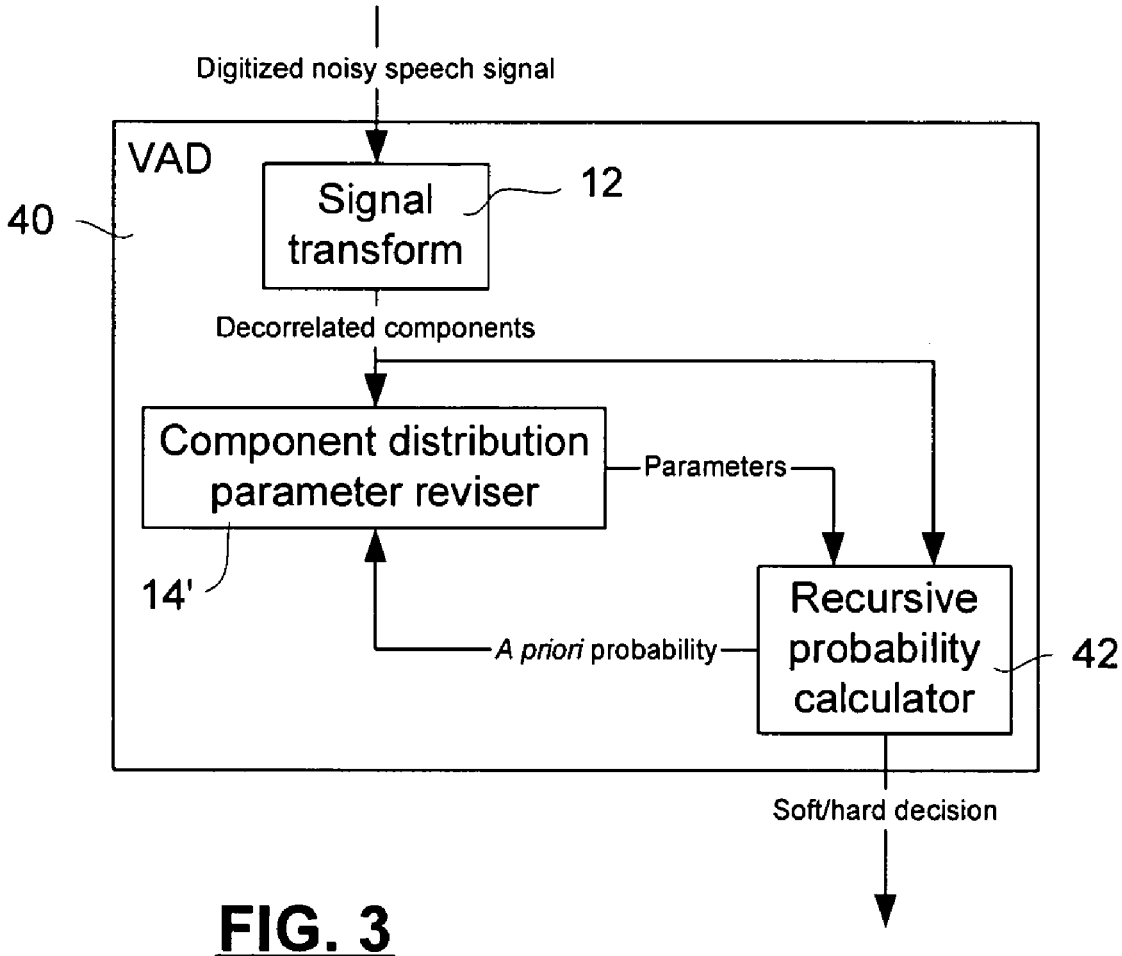
FIG. 3 is a schematic block diagram illustrating an embodiment of a voice activity detector in accordance with the invention.

FIG. 3 schematically illustrates principal functional blocks of a voice activity detector apparatus (VAD) 40 in accordance with an embodiment of the invention.

The component distribution parameter reviser 14' takes an a priori probability distribution function as the prediction used to determine which parameter to update. The component probability distribution parameter reviser 141 is substantially the same as the component distribution parameter reviser 14 shown in FIG. 1*a*. The only part of the VAD 40 that was not described above is a recursive probability calculator 42. The recursive probability calculator 42 is adapted to receive the current parameters, and to compute the Gaussian noise distributions and composite Gaussian noise and Laplacian voice signal distributions of a form predicted by a theory of the noise-contaminated speech signal. The recursive probability calculator 42 uses the Gaussian and composite distributions to compute measures of fit of the received components $v_i$ to both the corresponding $i^{th}$ Gaussian and composite distributions. This may be accomplished by evaluating each of the computed $i^{th}$ distributions, at the corresponding $v_i$. The measures of fit to the distributions are used to compute a soft decision relating to the existence of speech in the frame Y(m) being analyzed, and an a priori prediction of how the next received components are to be analyzed is computed by the recursive probability calculator 42. A more specific example of an algorithm for deciding whether a frame Y(m) includes a speech signal, and for generating the prediction, is described below with reference to steps 126-128 of a flowchart shown in FIG. 4.

The VAD 40 can be combined with a speech enhancement apparatus in accordance with the invention, in which case only one signal transform 12, and one component distribution parameter reviser 14 is required, consequently, the VAD 16 shown in FIG. 1*a* can be for example, only in the recursive probability calculator 42.

Figure 4:
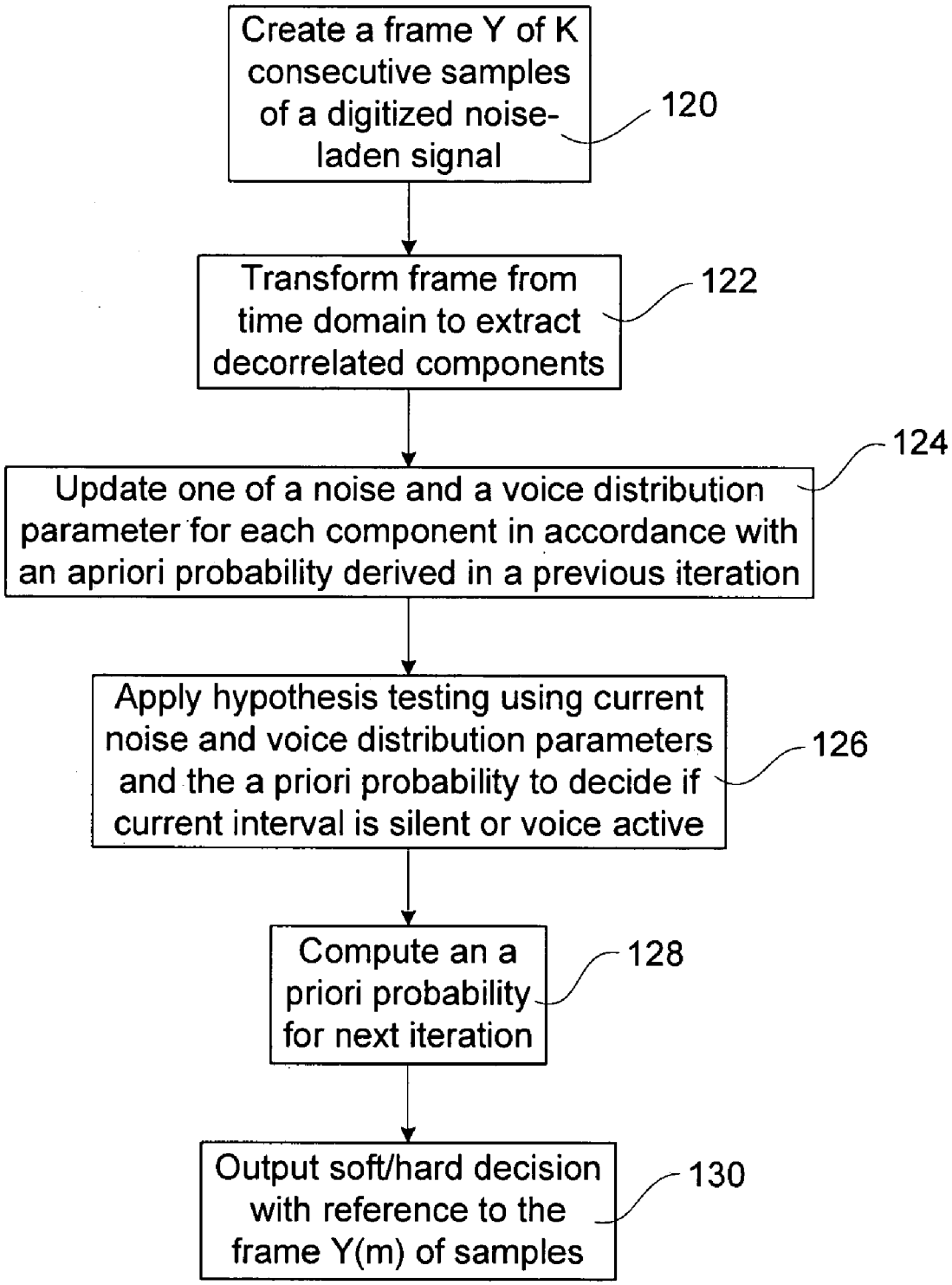
FIG. 4 is a flow chart illustrating principal steps involved in voice activity detection in accordance with an embodiment of the invention.

FIG. 4 illustrates principal steps in a method of voice activity detection in accordance with an embodiment of the invention. Steps 120 and 122 are substantially identical to steps 100 and 102 of the flow chart shown in FIG. 2, and relate to the decomposition of a frame Y(m) of K consecutive samples into the decorrelated components $V(m)=v_i$, i=1 . . . K. As well, in step 124 in which either the parameter associated with the Gaussian noise distribution or the Laplacian speech distribution is updated, is the same as step 104 of the flow chart shown in FIG. 2, except for the condition used to select which of the two parameters to update.

If an a priori probability $P_{m|m-1}$ (computed when the m−1 components were processed) is less than ½, a noise-contaminated voice signal is not mathematically expected given data available up to receipt of the previous frame (Y(m−1)). Accordingly, each component $v_i$ of V(m) is processed as noise. Conversely, if $P_{m|m-1}$ is greater than or equal to ½, the components are assumed to be noise-contaminated voice signal, and a method for updating at least the Laplacian factor is applied. The a priori probability is a prediction of a hidden state of a hidden Markov model (HMM) well known in the art for modeling random processes. Computation of the a priori probability is further discussed below with reference to step 128.

The Gaussian variance parameter $\sigma^2$ is updated in the manner described above, for example, if $P_{m|m-1}<½$. Otherwise a noise-contaminated voice signal component is assumed, and $\alpha_i$ (the Laplacian factor of the Laplacian signal distribution) is updated using, for example, the first order filter described above.

In step 126, for each component, two competing hypotheses are examined by the evaluation of two corresponding probability distributions. The current parameters $\sigma_i^2$ and $\alpha_i$, and the vector component ($v_i$) are used to compute a measure of conformity of the components to a Gaussian noise probability distribution and a composite Gaussian and Laplacian probability distribution of a form dictated by theoretical assumptions about the sound and noise signal. The Gaussian noise probability distribution $f_{0,i}(m)$ is the probability distribution of an outcome "0" (optionally indexed by i), which here signifies the hypothesis that a component is only noise.

$$f_{0,i} = \frac{1}{\sqrt{2\pi}\,\sigma_i} e^{-\frac{v_i^2}{2\sigma_i^2}}$$

Evaluating $f_{0,i}$ for a component $v_i$ yields a measure of how well the component $v_i$ fits the Gaussian noise distribution.

Likewise current values of $\alpha$ and $\sigma^2$ are computed to produce a composite probability distribution of a form defined by the product of Gaussian and Laplacian distributions of an outcome "1". The outcome 1 represents the probability of the component being a noise-contaminated signal. The $f_{1,i}$ distribution is likewise evaluated at $v_i$ to obtain a measure of how well the value of the $i^{th}$ component fits the composite probability distribution.

$$f_{1,i} = \frac{1}{4a_i} e^{-\frac{\sigma_i^2}{2a_i^2}} \left[ e^{\frac{v_i}{a_i}} erfc\left(\frac{\sigma_i^2 + a_i v_i}{\sqrt{2}\,\sigma_i a_i}\right) + e^{-\frac{v_i}{a_i}} erfc\left(\frac{\sigma_i^2 - a_i v_i}{\sqrt{2}\,\sigma_i a_i}\right)\right]$$

where erfc is the complementary error function well known in the art. I.e.:

$$erfc(x) = \int_x^\infty \frac{2}{\sqrt{\pi}} e^{-t^2}\, dt.$$

The $f_{0,i}(v_i)$ and $f_{1,i}(v_i)$ are computed for each component $v_i$ of V.

The product of the evaluations of $f_{1,i}$ from i=1 . . . K, is divided by the product of the evaluations of $f_{0,i}$ from i=1 . . . K, yielding L(m). I.e.:

$$L(m) = \prod_{i=1}^{K} \frac{f_{1,i}(m)}{f_{0,i}(m)}$$

L(m) is a positive real number. If L>1, more of the components fit the composite distribution better than they fit the Gaussian distribution. Conversely, L<1, more of the components fit the Gaussian distribution better than they fit the composite distribution. If L=1, then the algorithm has failed to determine whether the frame contains only noise or noise-contaminated voice signal.

It should be noted that while computing L(m) is an effective way of determining the fit of the components to the respective distributions, other methods can be used to derive a value indicating whether the frame Y(m) (as evidenced by the components v(m)) constitutes noise or noise-contaminated voice signal. More specifically, because some components may be only noise while others are noise-contaminated voice signal, a high measure of fit of one component to the Gaussian noise distribution may be weak evidence that a frame contains only noise, whereas a high measure of fit of a component to the composite Gaussian and Laplacian noise distribution may be a strong indicator that a noise-contaminated voice signal is contained in the frame, especially if the variance $\sigma^2$ is small and the factor $\alpha$ is large.

L(m) is used to compute $P_{m|m}$: an a posteriori probability that frame Y(m) constitutes noise-contaminated signal given the state of information after receiving V(m).

$$P_{m|m} = \frac{L(m)P_{m|m-1}}{L(m)P_{m|m-1} + (1 - P_{m|m-1})}$$

$P_{m|m}$ is the principal output of the VAD, and may be in soft or hard form. If L>1 the a posteriori probability is greater than the a priori probability in proportion to L; if L=1, the a priori probability equals the a posteriori probability; and for L<1 a posteriori probability diminishes with respect to the a priori probability. The computing of the a posteriori probability completes the hypotheses testing of step 126.

In step 128', the method of voice activity detection computes an a priori probability $P_{m+1|m}$ to be used when processing the components of V(m+1). As explained above, the conditional probabilities vary with i, but are averaged for each frame m. Accordingly, all of the components derived from a frame Y(m) are collectively inferred to be only noise, or to be noise-contaminated voice signal. The next a priori probability is computed by multiplying empirically derived fixed transition probabilities $\Pi_{01}$, and $\Pi_{11}$, (i.e. a probability of transiting from state 0 to state 1 and the probability of returning to state 1 from state 1 in successive frames) by the a posteriori probability of being in initial state 0 and 1 respectively. The predefined fixed transition probabilities are consistent with the random variable treatment of the components, and can be empirically derived using known techniques. The transition probabilities should be carefully selected and may be determined by analysis of a statistical sample of typical speech. The greater $\Pi_{11}$, the less likely a frame that exhibits marginal voice content following a voice-active frame, will be deemed noise. Conversely, the smaller $\Pi_{11}$, the less the marginal voice content will be included as voice-active content. The sum of $\Pi_{01}$ and $\Pi_{11}$ is the probability of voice activity in a random frame.

In step 130, a soft or a hard decision derived from the a posteriori probability is output, optionally along with the vector V(m) or an interval/time reference associated with m. The output of such a voice activity detection method may be used to detect speech on a noise-contaminated communications channel connection to an interactive voice response unit or other automated voice interface in a public switched telephone network, for example.

The invention can be applied in any apparatus where the differentiation of noise and signal is desired, and not only in the speech enhancement or voice activity detector applications presented herein for purposes of illustration. Any signal that conforms to a probability distribution that is different from the Gaussian noise distribution can be detected and separated from the noise using the methods in accordance with the invention.

The embodiments of the invention described above are therefore intended to be exemplary only. The scope of the invention is intended to be limited solely by the scope of the appended claims.

We claim:

1. A method for discriminating noise from signal in a noise-contaminated signal, comprising:

decomposing a frame of the noise-contaminated signal received in a predefined time period into decorrelated signal components;

for each component:

i) recursively updating respective parameters characterizing a Gaussian noise distribution and a signal distribution of the component as a function of time;

ii) using the respective parameters to evaluate a composite Gaussian and signal distribution function to provide an estimate of noise and signal contributions to the component; and attenuating the component in proportion to the estimated noise contribution to the component;

wherein the signal is a noise-contaminated voice signal and recursively updating comprises recursively updating respective parameters characterizing the Gaussian noise distribution and a Laplacian voice distribution;

wherein recursively updating respective parameters comprises using a value computed during processing of a previous frame to select which of the parameters characterizing each distribution to update;

wherein the value computed during processing of a previous frame is an a priori probability that the frame constitutes noise, and using the a priori probability to select which of the parameters to update comprises:

i) selecting a measure of variance that characterizes the Gaussian noise distribution if the a priori probability is below a predetermined threshold; and ii) otherwise selecting a measure of variance factor that characterizes the Laplacian distribution;

wherein the a priori probability is defined by evaluating a hidden state of a hidden Markov model; and wherein recursively updating a parameter further comprises incrementally changing the parameter in accordance with a difference between an expected value of the component given the past value of the parameter, and the value of the component received; and wherein incrementally changing the parameter comprises applying a first order smoothing filter to the components.

2. The method as claimed in claim 1 wherein a time constant of the first order smoothing filter is chosen as a time during which the distribution is stationary.

3. A method for discriminating noise from signal in a noise-contaminated signal, comprising:

decomposing a frame of the noise-contaminated signal received in a predefined time period into decorrelated signal components;

for each component:

i) recursively updating respective parameters characterizing a Gaussian noise distribution and a signal distribution of the component as a function of time;

ii) using the respective parameters to evaluate a composite Gaussian and signal distribution function to provide an estimate of noise and signal contributions to the component; and attenuating the component in proportion to the estimated noise contribution to the component;

wherein the signal is a noise-contaminated voice signal and recursively updating comprises recursively updating respective parameters characterizing the Gaussian noise distribution and a Laplacian voice distribution;

wherein recursively updating respective parameters comprises using a value computed during processing of a previous frame to select which of the parameters characterizing each distribution to update;

wherein the value computed during processing of a previous frame is an a priori probability that the frame constitutes noise, and using the a priori probability to select which of the parameters to update comprises:

i) selecting a measure of variance that characterizes the Gaussian noise distribution if the a priori probability is below a predetermined threshold; and ii) otherwise selecting a measure of variance factor that characterizes the Laplacian distribution;

wherein using the respective parameters to determine which of the parameters to update comprises computing a measure of fit of the components to a composite Gaussian and Laplacian distribution;

wherein using the respective parameters to determine which of the parameters to update further comprises:

i) computing a measure of fit of each of the received components to a respective Gaussian noise distribution defined using the respective parameters; and ii) comparing a mean of the measures of fit to the respective Gaussian noise distributions with a mean of the measures of fit to the composite Gaussian and Laplacian distributions, to compute a likelihood that the components of the frame constitute noise or noise-contaminated voice signal;

wherein computing a measure of fit to either of the distributions comprises evaluating the distribution at the value of the component received; and wherein comparing a mean of the measures of fit comprises dividing a product of the measures of fit of the components to the composite Gaussian and Laplacian distribution by a product of the measures of fit of the components to the noise distribution.

4. The method as claimed in claim 3 wherein using the respective parameters to evaluate further comprises using the likelihood and the a priori probability to compute an a posteriori probability that the frame is noise-contaminated voice signal.

5. The method as claimed in claim 4 wherein using the respective parameters to evaluate further comprises using the a posteriori probability and a predefined fixed set of transition probabilities to compute an a priori probability that a next frame constitutes noise-contaminated voice signal.

6. A method for discriminating noise from signal in a noise-contaminated signal, comprising:

decomposing a frame of the noise-contaminated signal received in a predefined time period into decorrelated signal components;

for each component:

i) recursively updating respective parameters characterizing a Gaussian noise distribution and a signal distribution of the component as a function of time;

ii) using the respective parameters to evaluate a composite Gaussian and signal distribution function to provide an estimate of noise and signal contributions to the component; and attenuating the component in proportion to the estimated noise contribution to the component;

wherein using the respective parameters to evaluate a composite Gaussian and signal distribution function comprises computing at least an approximation to an expected value of the composite Gaussian and signal distribution using a respective value of each component, and the parameters, to obtain a corresponding signal-enhanced component, if it is determined that the frame is signal active; and wherein computing at least an approximation comprises computing a piece-wise function approximation of the expected value as a function of the parameters and the component.

* * * * *